United States Patent [19]

Strutz et al.

[11] 3,970,231

[45] July 20, 1976

[54] METHOD AND DEVICE FOR STARTING UP INJECTOR NOZZLES

[75] Inventors: Hans-Jürgen Strutz; Ingolf Jacob, both of Bobingen, Germany

[73] Assignee: Hoechst Aktiengesellschaft, Frankfurt am Main, Germany

[22] Filed: Aug. 5, 1974

[21] Appl. No.: 494,510

[30] Foreign Application Priority Data

Aug. 4, 1973 Germany ..... 2339603

[52] U.S. Cl. ..... 226/7; 226/89; 226/91; 226/97

[51] Int. Cl.[2] ..... B65H 17/32

[58] Field of Search ..... 226/7, 91, 97, 89; 28/1.4

[56] References Cited

UNITED STATES PATENTS

| | | | |
|---|---|---|---|
| 2,661,588 | 12/1953 | Griset | 226/97 X |
| 3,296,679 | 1/1967 | Jobson | 28/1.4 |
| 3,423,000 | 1/1969 | Heinen | 28/1.4 X |

FOREIGN PATENTS OR APPLICATIONS

| | | | |
|---|---|---|---|
| 1,043,647 | 9/1966 | United Kingdom | 226/97 |

*Primary Examiner*—Richard A. Schacher
*Attorney, Agent, or Firm*—Connolly and Hutz

[57] ABSTRACT

To facilitate the introduction of running yarns into injector nozzles the cross section of the inlet openings of the said nozzles are enlarged before the yarns are laid in, the yarns are sucked into the enlarged openings and subsequently the openings are reduced to their initial dimensions. The injector nozzles are preferably used in jet stufferbox texturizing processes or with suction guns. Without special threading aids, yarns and threads supplied at high speed are sucked in automatically and conveyed into spaces under elevated pressure.

13 Claims, 11 Drawing Figures

METHOD AND DEVICE FOR STARTING UP INJECTOR NOZZLES

In the processing of yarns and threads injector nozzles are used for the most different purposes, they serve to convey or draw off the yarns, as suction gun to lay the yarns on running godets, as draw-off and stretching nozzles in the manufacture of spun fiber fleeces, as interlacing nozzles and as draw-in nozzles in the jet stufferbox texturizing process.

The principle of the said injector nozzles is that a jet of a fluid is directed onto the thread. In most cases, the thread and the fluid are supplied in separate channels and meet in the impulse zone designed in accordance with the processing aim.

In the operation of injector nozzles two working conditions have to be distinguished:

In stationary operation a high current of motive fluid ensures a sufficient impulse transmission in the impulse zone of the nozzle to the thread to be conveyed and thus brings about the desired transport of the thread. When starting up injector nozzles at first a direct impulse of the fluid current is not transmitted to the thread to be transported, but rather a vacuum must prevail in the inlet channels so that a thread or yarn coming in the vicinity of the injector nozzles is sucked in, possibly while being bent repeatedly. To this effect the throughput of motive fluid has mostly to be reduced with respect to the stationary state.

In stationary operation the fluid pressure in the impulse zone tries to become balanced in quite a number of injector nozzles also through the yarn inlet channels, i.e. opposite to the running direction of the yarn, whereby the draw-in force of the nozzle is reduced. The amount of refluent motive fluid is especially large in injector nozzles used to convey yarns into spaces under elevated pressure. In order to keep as small as possible this portion of the fluid current the inlet channels for the threads should have a very small diameter in conformity with the titer of the yarns to be transported. When the suction effect of the injector nozzle is maintained also in the stationary operation, narrow yarn inlets reduce the aspiration of false air. Whereas in stationary operation a small diameter of the yarn inlet channels in necessary, as large as possible a diameter is required for starting up the injector nozzles, i.e. for the automatic aspiration of the yarn permitting a two- or many-fold folding up of the yarn. Injector nozzles with yarn inlet channel of optimum dimension for stationary operation are not in a position to suck in the yarn automatically when starting up and, therefore, they cannot be used in continuous processes with rapid yarn supply.

For this reason injector nozzles with threading slits have been proposed (of, German Utility Model 73 06 184). But owing to the asymetrical supply of the motive fluid, nozzles of this type always have a whirling effect. Hence, they are unsuitable at least for some fields of application, for example in jet stufferbox texturization and in the manufacture of spun fiber fleeces.

British Pat. No. 1,043,647 describes a transport nozzle for a plurality of continuously supplied yarns wherein the individual yarns are conveyed separately fron one another to avoid electrostatic charge. To this effect a plurality of parallel injector nozzles are arranged in a common nozzle body in a circle which is concentric with respect to the axis of the body. The nozzle body thus consists of a cylinder and a larger hollow cylinder in which the yarn inlet channels are formed by a groove each in both cylinders. When the two cylinders are taken asunder, the yarns can then be laid into the grooves. In the separated state the individual injector nozzles do not exhibit a conveying effect and, hence, the yarns must be drawn off by an auxiliary device, for example another injector nozzle, until the two cylinders have been combined again to form the nozzle body and each of the injector nozzles has a conveying effect on the yarn. By the lateral air supply to the individual injector nozzles an interlacing of the conveyed yarn can hardly be avoided either in this case.

A further possibility to introduce the continuously supplied yarn into the narrow inlet channels of an injector nozzle is described for suction guns in German Offenlegungsschrift 1,660,671. In this case, opposite to the inlet opening of the yarn inlet channel a blow nozzle is provided to blow the yarn into the inlet opening. In the proposed device the mouthpiece of the suction gun does not lay open so that it must be continually turned, for example when the yarns are placed on running godets with the aid of the suction pistol, as otherwise the yarn would wind round the head of the blow nozzle. Moreover, such a device would be too expensive for injector nozzles with several inlet channels and difficult to handle.

German Offenlegungsschrift 2,164,802 provides a process for drawing running yarns into narrow channels, for example inlet channels of jet stufferbox texturizing devices, wherein the yarn is drawn in by means of a wire loop passed through the inlet channel and accelerated by an auxiliary device, for example a tension spring. This process requires additional and expensive auxiliary devices and is readily liable to trouble.

It is the object of the present invention to provide a process and a device for starting up injector nozzles according to which the running yarns can be easily introduced into the injector nozzles without expensive auxiliary means.

According to the invention the cross section of the inlet opening of the injector nozzle is enlarged before the yarns are laid in, the yarns are sucked into the enlarged openings and subsequently the openings are reduced to their initial dimensions. The cross sections of the yarn inlet openings can be enlarged by removing inside elements or by division into segments within the inside elements.

To carry out the process of the invention injector nozzles with conical needle formed by two concentric shaped bodies, the inner one of which can be removed, are preferably used. The yarn is sucked into the larger opening remaining after the removal of the inner element.

Especially suitable are injector nozzles in which the surfaces of contact of inner element and outer element of the conical needle have the shape of a cone and are provided with recesses forming separate inlet channels for the yarns when the two elements are assembled.

Conical needles are intended to include all nozzle needles the cross sectional area of which diminishes in the running direction of the yarn. Instead of being divided in an inner element and an outer element, the needle may be composed of an inner cone and a matching hollow body which can be sealed one with respect to the other.

The process of the invention offers considerable advantages in a number of applications:

In certain processes it is absolutely necessary to use injector nozzles having narrow inlet channels for the yarn in order to prevent the motive fluid from refluxing to a large extent, as otherwise the inlet tension of the yarn would be reduced. By adapting the narrow inlet channels to the titer of the yarn the motive fluid can be brought nearer to the threads so that an optimum impulse transmission from the fluid to the threads is ensured. When corrosive fluids or media of high temperature are used, narrow inlet channels keep down the proportion of recurrent and escaping treating medium so that the working conditions of the operating personnel are not affected. If a suction effect of the injector nozzles is maintained also in stationary operation narrow inlet channels reduce the aspiration of false air. Furthermore, it has been observed that the yarns in injector nozzles with narrow inlet channels are entangled and distorted to a smaller extent.

As already mentioned above, the use of narrow inlet channels is accompanied by difficulties of threading or sucking in threads and yarns. The introduction of even one thread end requires much skill and time so that during threading the yarn supply has to be interrupted.

Processes with continuous yarn supply, for example an integrated spinning-drawing-blowing-crimping process, are only possible with starting up aids for the injector nozzle of the crimping device.

In contradistinction to known processes, the method and device of the invention do not require any auxiliary device for starting up the injector nozzles, for example a device which has to be attached to the injector nozzle if need arises and must be adjusted. Hence, sources of trouble and additional working stages can be avoided.

In accordance with the method and device of the invention the function of the injector nozzle to suck in and transport yarns is maintained during the period the cross sectional area of the yarn inlet channels is enlarged. Thus additional draw-off devices need not be used. When simultaneously a heat treatment is carried out in the injector nozzle according to the invention by using a hot medium, this heat treatment is not interrupted during starting up and, therefore, yarn material with differing properties is not obtained.

The method of the invention is especially suitable for injector nozzles used as draw-in nozzles in jet stufferbox texturizing devices, for example as described in German Democratic Republic Pat. No. 17,786. It is also very suitable in jet stufferbox texturizing processes in which the yarn is conveyed against excess pressure, for example as described in German Offenlegungsschrift 2,036,856.

The method in accordance with the invention permits a symmetrical admission of motive fluid to the threads as well as a separate supply of a further fluid medium. Hence, it is especially suitable for draw-in nozzles of jet stufferbox texturizing processes in which several threads run in through separate channels and are kept apart from one another by the current of a separating fluid. A process of this type is described, for example, in German Offenlegungsschrift No. 2,217,109.

A further interesting field of application of the method of the invention are suction guns. When threads are placed on rapidly running godets with the aid of suction guns a high draw-in tension of the threads ensures an unobjectionable laying and avoids coil formation. High inlet tension can only be reached with suction nozzles with narrow inlet channels, but, as already mentioned above, narrow inlet channels are an obstacle to the taking over of the continuously supplied threads in the suction gun.

According to the invention, the cross sectional area of the inlet channel is therefore enlarged for taking over the thread and subsequently it is reduced again so that high yarn inlet tensions can be obtained. The method and device in accordance with the invention do not impair the necessary handiness of suction guns, the exposed mouthpiece permits an undisturbed laying of threads onto running godets.

The device according to the invention can be combined with known devices for varying the throughput of motive fluid. Such a combination permits, for example, to reduce the amount of fluid when the inlet channel is enlarged and thus ensures an optimum suction effect during threading. During or after the reduction of the diameter of the inlet channel to the initial value, i.e. to the diameter for the stationary working state of the nozzle, the throughput of motive fluid can be increased again and the injector nozzle can then be operated with an optimum impulse transmission in the impulse zone.

The method and device of the invention will now be described in further detail with reference to the accompanying drawings in which FIG. 1 is a longitudinal view of a jet stufferbox injector nozzle for 4 threads with drawn out inner element FIG. 2 is a cross sectional view on an enlarged scale along line I — I of FIG. 1

Figure 1:
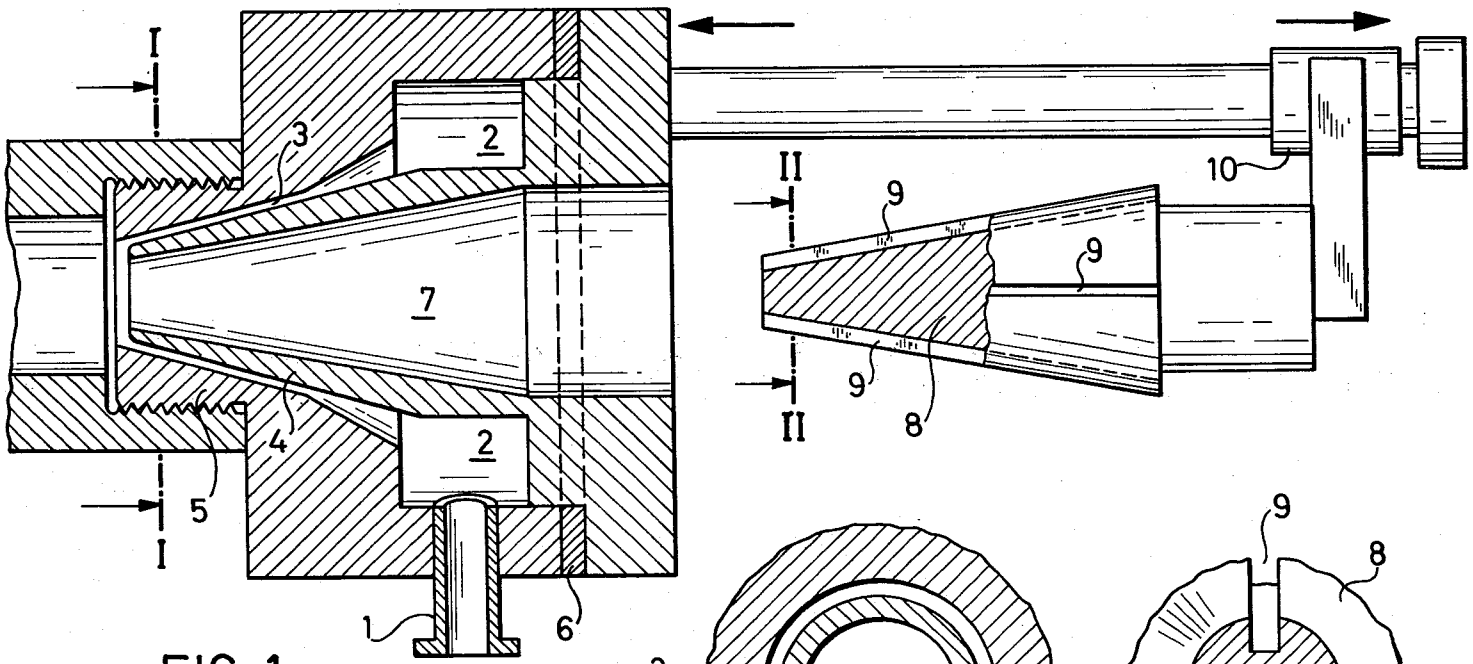

Referring to the drawing:

In the injector nozzles for jet stufferbox texturization represented in FIGS. 1 to 6 the motive fluid streams through inlet 1 into the distribution zone 2 and escapes through annular slit 3 at a high speed. The annular slit 3 is formed by the conical nozzle needle 4 or 4′ and the countercone 5, its cross section is determined by the position of the needle 4 or 4′, respectively, which is adjusted by spacer rings 6 or other suitable means.

Figure 4:
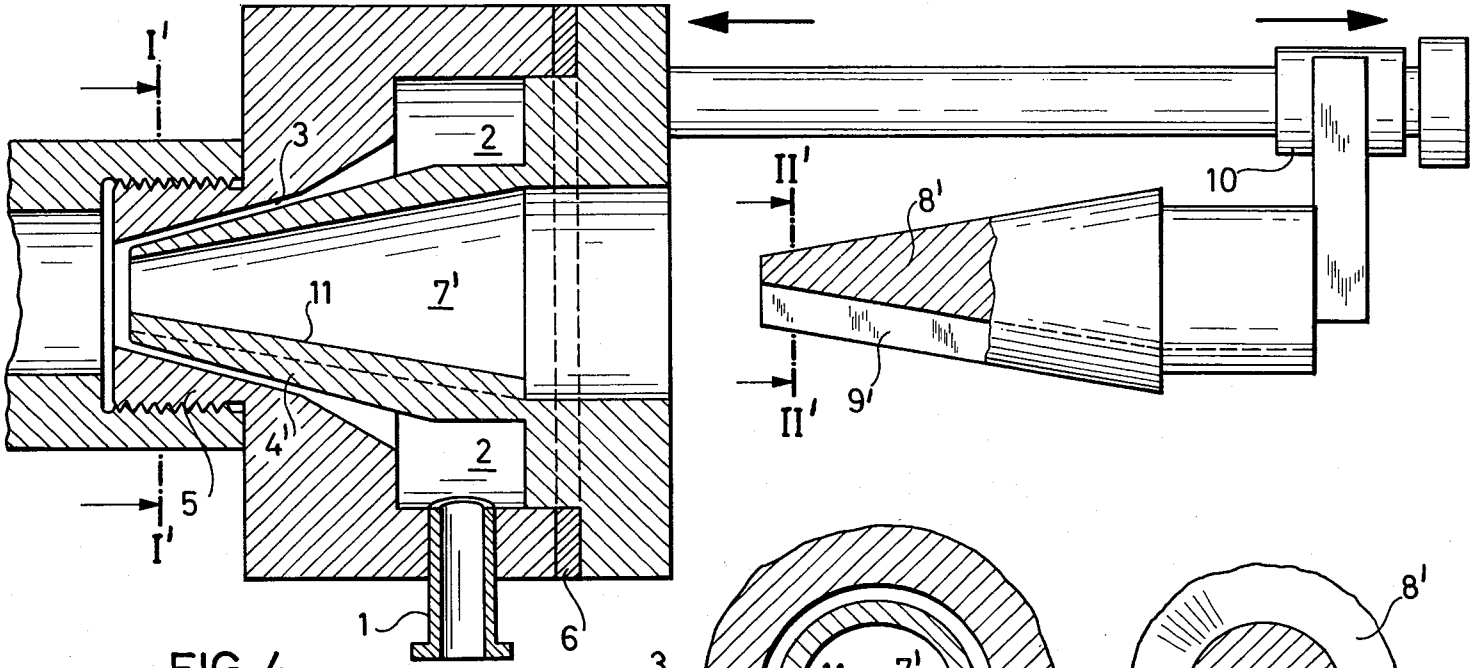
FIG. 4 is a longitudinal view of another injector nozzle according to the invention for one thread with pulled out inner element

The conical nozzle needle 4 or 4′ contains a conical inner element 8 or 8′ having the same axis, which can be pulled out and pushed back by a suitable device 10. In FIGS. 1 and 4 the inner element is represented in pulled out position so that the conical bore 7 or 7′ in the needle is empty. As the needle remains in a fixed state, the suction and conveying effect of the injector nozzle is maintained. Owing to the fact that the cross section at the most narrow point of the bore 7 or 7′ is much larger than that of the continuously supplied threads, the latter are easily sucked in. The threads are then taken over by the motive fluid flowing through annular slit 3 and transported into the zone following the injector nozzle.

Figure 2:
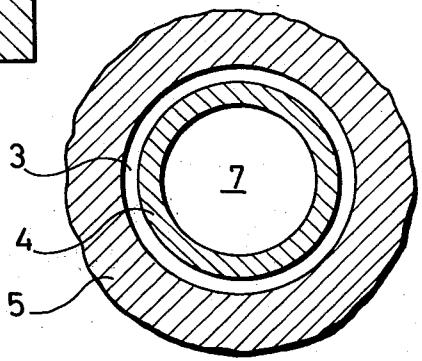
Figure 3:
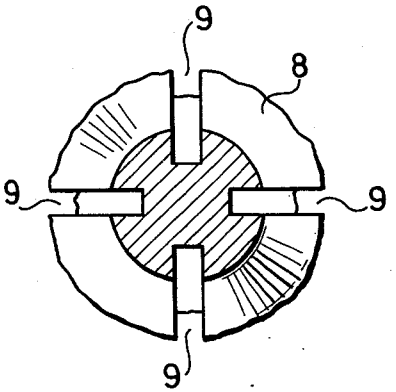
FIG. 3 is a cross sectional view on an enlarged scale along line II — II of the drawn out inner element

In the injector nozzle represented in FIGS. 1 to 3 the inner cone 8 is provided on its outer surface with 4 grooves 9 into which the incoming threads are laid. After having pushed the inner cone 8 into bore 7, into which it fits tightly, grooves 9 form four inlet channels for the threads through which each one of the threads runs separately into the injector nozzle.

Figure 5:
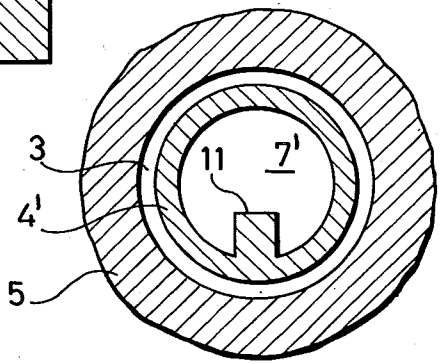
FIG. 5 is a cross sectional view on an enlarged scale along line I′ — I′ of the injector nozzle of FIG. 4
Figure 6:
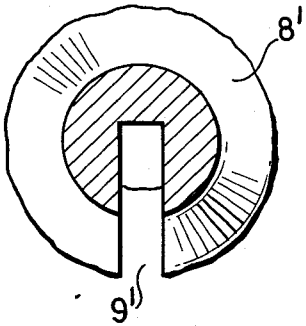
FIG. 6 is a cross sectional view on an enlarged scale along line II′ — II′ of the inner element of FIG. 4

In the injector nozzle represented in FIGS. 4 to 6 the inner cone 8′ is provided with one surface groove 9′ which is so deep that in the narrow part of the inner cone it reaches beyond the center axis thereof. The thread or threads are placed into the groove 9′. The conical bore 7′ is provided with an elevation 11 which, with fitted in inner cone 8′, partially fills out the groove 9′ in a manner such that a narrow inlet channel is formed ending in the center of the narrow end surface of the needle.

Further embodiments of the invention are represented in FIGS. 7 to 11 illustrating two examples of suction guns in which the cross section of the inlet channel for the thread can be varied.

The motive fluid flows through conduit 12 into the distributing zone 13 and from there to the annular slit 14, which is formed by the nozzle needle 15, the conical inner body consisting of either two segments 16 (FIGS. 7 and 8) or 4 segments 16′ (FIGS. 9 to 11) and counter cone 17. The size of the annular slit 14 can be varied for example by turning the tube 18 with its thread in the corresponding thread of tube 19. To the outside the inner cone (segments 16 or 16′) ends in a cylindrical mouthpiece and with fitted in inner cone the segments and the mouthpiece form the narrow inlet channel 21.

Figures 7, 8:
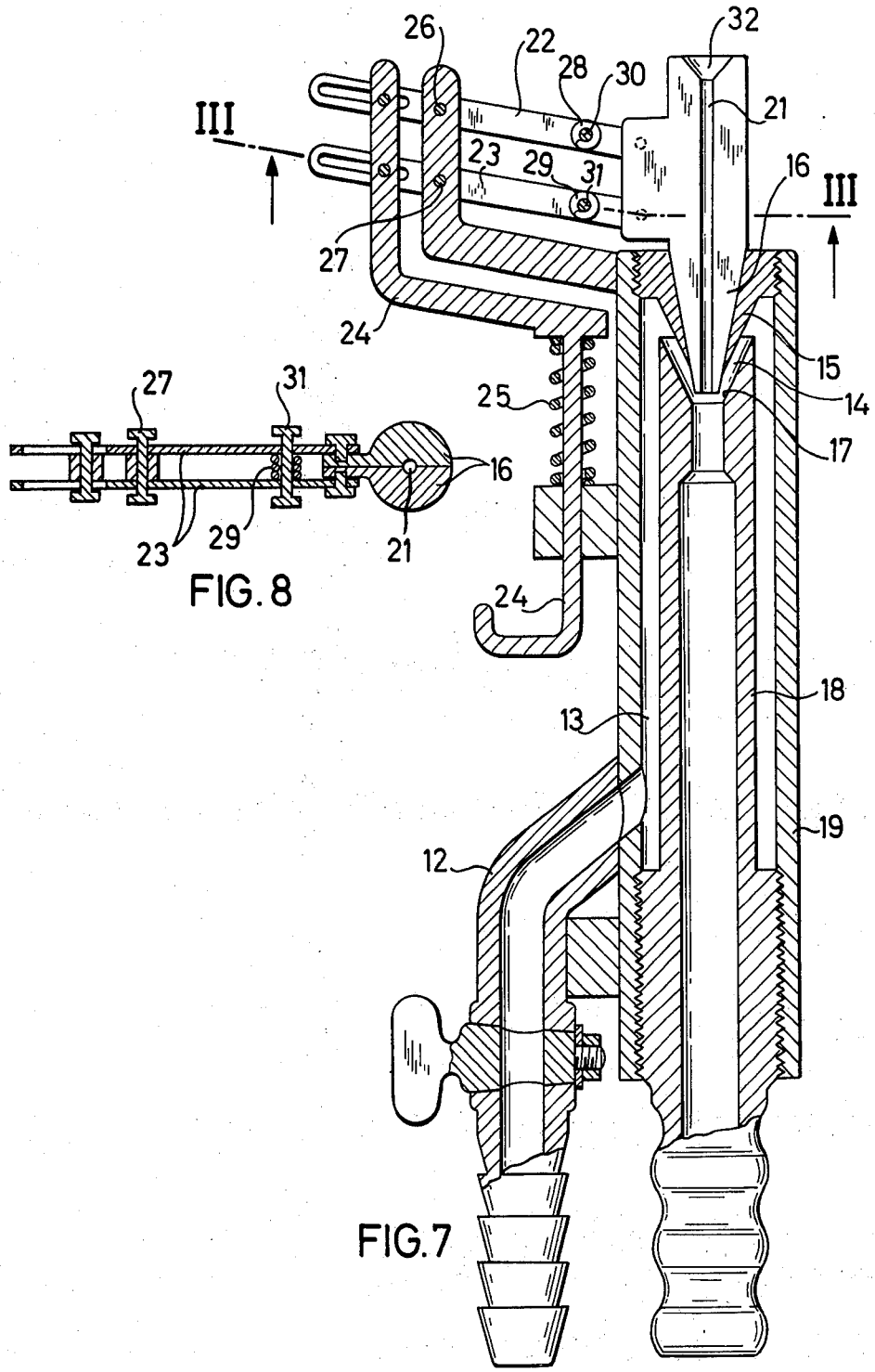
FIG. 7 is a longitudinal view of a suction gun in accordance with the invention set to stationary operation
FIG. 8 is a cross sectional view along line III — III of the gun of FIG. 7

In the suction guns represented in FIGS. 7 and 8 the segments 16 can be fully pulled out of the needle 15 with the aid of a suitable device and turned to the side. The said device comprises two parallel guides 22, 23, one for each segment 16. The parallel guides are operated by pull rod 24 which is held in the shown end position by pressure spring 25. When rod 24 is pulled, the arms 22, 23 turn round the points of rotation 26, 27, the segments 16 are lifted from their conical seat and turned to the side. The pressure springs 28 and 29 can then press apart the two segments 16 until the arms 22 and 23 lie against the projecting edges of spacers 30 and 31. After having pulled out the inner body (segments 16), the threads can be sucked into the remaining hollow cone of the needle which is now distinctly enlarged. In this state of operation the suction gun is approached to the threads which are easily sucked into enlarged inlet opening.

When the threads have been sucked in, rod 24 is slowly relaxed and the segments 16 are pulled into the hollow cone of the needle 15 whereby they are pushed together and form again the inner element with inlet opening for the thread 21 in its axis. Thus the cross section of the opening to suck in the thread is reduced again to the size of the inlet channel 21.

When the segments 16 are pushed together the incoming threads are guided with the aid of funnel 32 into the inlet channel 21 so that they are not pinched between the segments 16.

Figure 10:
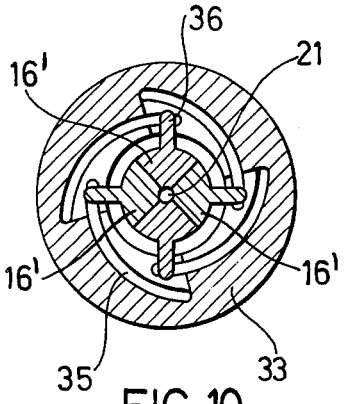
FIG. 10 is a cross sectional view along line IV — IV of the suction gun of FIG. 9
Figure 11:
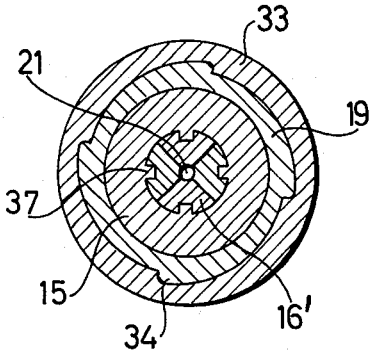
FIG. 11 is a cross sectional view along line V — V of the suction gun of FIG. 9.
Figure 9:
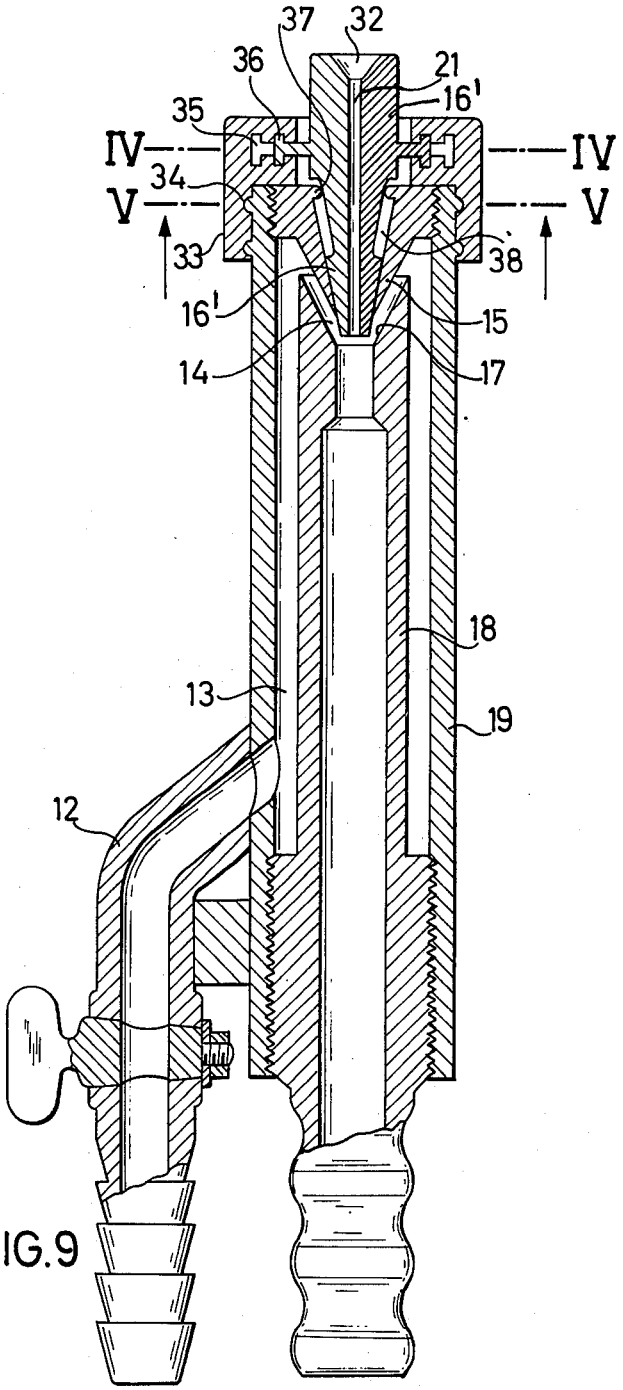
FIG. 9 is a longitudinal view of another suction gun according to the invention set to stationary operation

In the suction gun represented in FIGS. 9 to 11 the segments 16′ of the inner body are pulled forward and apart by a turning mechanism whereby the inlet opening 21 for the thread is distinctly enlarged by turning cap 33 anticlockwise. When the cap 33 is turned back, the segments 16′ of the inner body are pushed completely into the hollow cone of the needle 15 to the inner body.

Cap 33 is rotated on tube 19 in the coarse thread 34; with anticlockwise rotation it moves forward at the same time. Parallel to plane IV — IV the cap 33 contains 4 excentric grooves 35 in which engage one guide pin 36 each of the respective segment 16′ of the inner body. The fixed pins 37 engage in the grooves 38 of the segments 16′ to avoid a turning of the said segments with the cap 33. When the cap 33 is turned the guide pins 36 pass along the excentric path of grooves 35, the segments are moved forward and pulled apart.

In this state of operation with pulled out segments and enlarged inlet channel the threads can be readily sucked into the gun. By turning back cap 33 the segments 16′ are completely entered into the hollow cone of the needle 15. The incoming threads are guided in the inlet channel with the aid of funnel 32 in a manner such that they do not get pinched between the segments 16′. When the segments 16′ of the inner body have been replaced, the inlet for the thread has again the size of the channel 21.

What is claimed is:

1. A process for introducing one or several threads into an injector nozzle, having a sucking inlet opening or openings through which a flow of motive fluid transports the threads, which comprises introducing the threads to the sucking inlet opening or openings, arranging the cross-sectional area of the sucking inlet opening or openings, a finite amount larger than the normal thread transporting size, causing the motive fluid to flow through the nozzle whereby the threads are sucked through the finitely larger sucking inlet opening or openings to insert them into the nozzle, and reducing the cross sectional area of said inlet opening or openings to their transporting size for transporting the threads through the nozzle.

2. The process as claimed in claim 1, wherein the cross sectional areas of the inlet openings are enlarged by removing inner elements.

3. The process as claimed in claim 2, wherein several separate thread inlet openings are combined to form a large opening by the removal of the inner element, several threads are sucked into the large opening, the individual threads are separated from each other by guide means, and the inner element is replaced so that each thread passes into the respective opening.

4. The process as claimed in claim 1, wherein the injector nozzle has a casing with a supply conduit for the motive fluid, an inner impulse transmission zone and an outlet for the transported material and an inner part with at least one inlet channel for the thread with inlet opening, and wherein the cross-sectional area of the inlet is enlarged by moving the inner element back away from the casing along its longitudinal axis.

5. The process as claimed in claim 4, wherein the throughput of motive fluid is reduced lower than transmission amounts to provide efficient suction effect during threading when the cross-sectional area of the inlet is enlarged.

6. The process as claimed in claim 5, wherein the throughput of motive fluid is increased to effective impulse transmission amounts when the cross-sectional area of the inlet is decreased.

7. An injector nozzle for conveying and drawing off threads and yarns comprising a. a casing with a supply conduit for the motive fluid, an inner impulse transmission zone and an outlet for the transported material, b. an inner part with at least one inlet channel for the thread with inlet opening and means to enlarge said inlet opening for threading by suction and to reduce the size of the opening to the normal state of transportation, c. the casing has a conical part, a conical nozzle needle disposed within the conical part of the casing and interspace between them, with supply of the motive fluid through the interspace between the conical part of the casing and the conical nozzle needle, and d. the nozzle needle comprises two concentric elements, the inner element which is provided with an inlet channel for the thread being constructed and arranged for removal from the needle during the suction step.

8. The injector nozzle as claimed in claim 7, wherein the contacting surfaces of inner element and outer element of the needle have a conical shape.

9. The injector nozzle as claimed in claim 7, wherein at least one of the concentric elements forming the nozzle needle are provided with grooves along their surface forming separated inlet channels for the threads when the two elements are assembled.

10. The injector nozzle as claimed in claim 7, wherein the inner element of the nozzle needle is composed of a plurality of segments which can be pulled apart to enlarge the inlet opening for the thread.

11. An injector nozzle as claimed in claim 10, wherein chucking means is provided for moving the plurality of segments away from the casing as they are pulled apart.

12. An injector nozzle as claimed in claim 7, wherein longitudinal translating means connects the conical nozzle needle to the casing whereby the conical nozzle needle is maintained concentrically aligned with the casing as it is moved to the rear and away from it for facilitating initial threading of the threads and yarns.

13. An injector nozzle as claimed in claim 7, wherein guide means are provided between the conical nozzle needle and the casing for maintaining the conical nozzle needle concentrically aligned with the casing as the conical nozzle needle is moved back and away from the casing, a predetermined distance whereby automatic threading of the starting end of the threads and yarns into the injector nozzle is facilitated.

* * * * *